US005542646A

United States Patent [19]

Bunyan

[11] Patent Number: 5,542,646

[45] Date of Patent: Aug. 6, 1996

[54] HYDRAULICALLY OPERATED FORCING TOOL

[76] Inventor: Peter Bunyan, 234 Old Towne Rd., Spartanburg, S.C. 29301

[21] Appl. No.: 345,574

[22] Filed: Nov. 28, 1994

[51] Int. Cl.[6] ..... B66F 3/24

[52] U.S. Cl. ..... 254/93 R; 29/239; 60/478

[58] Field of Search ..... 60/478; 92/82; 254/93 R, 937; 72/705; 29/239

[56] References Cited

U.S. PATENT DOCUMENTS

| | | | |
|---|---|---|---|
| 1,964,003 | 6/1934 | McBride | 60/478 |
| 2,527,428 | 10/1950 | Kemerer | 254/93 H |
| 2,618,929 | 11/1952 | Bidin | 60/478 |
| 3,003,659 | 10/1961 | Miller | 60/478 |
| 4,197,706 | 4/1980 | Blake | 60/478 |
| 4,827,719 | 5/1989 | Paoluccio | 60/478 |
| 5,048,794 | 9/1991 | Mamessier | 254/93 H |
| 5,048,795 | 9/1991 | Vitale | 254/93 R |
| 5,251,445 | 10/1993 | Farell et al. | 60/478 |

*Primary Examiner*—Robert C. Watson

*Attorney, Agent, or Firm*—Shlesinger, Fitzsimmons & Shlesinger

[57] ABSTRACT

The forcing rod of a hydraulically operated tool has thereon intermediate its ends an enlarged-diameter piston head which reciprocates in the bore of a cylinder housing, and divides the bore into a pressure chamber and a reservoir chamber. A hand-operated pump mechanism on the housing is operable to draw fluid from the reservoir chamber and to pump it under pressure into the pressure chamber, thereby causing the forcing rod to advance out of one end of the housing against the resistance of a return spring. Each of two plates removably secured to opposite sides of the housing contain to elongate chambers which communicate at one end with the reservoir chamber, and which contain spring-loaded pistons which function to maintain pressure on the fluid in the reservoir chamber.

13 Claims, 5 Drawing Sheets

HYDRAULICALLY OPERATED FORCING TOOL

BACKGROUND OF THE INVENTION

This invention relates to hydraulically operated tools, and more particularly to a hand-held forcing tool of the type having thereon a telescopic forcing rod which can be utilized for forcing or prying open doors, such as for example automobile or building doors which are jammed or locked closed.

It is often necessary for firemen or police officers, for example, to utilize some form of tool for prying or forcing open closed doors which have been locked or jammed into closed positions, such as for example as the result of an automobile accident, or in the course of attempting to enter a burning building or the like. Among the most fundamental tools for use in opening such doors is a conventional crow bar or pinch bar. However, in order to be able to exert even greater pressure, tools have been developed which utilize a hydraulic mechanism for gaining forced entry to a car, building, or the like. One such tool, by way of example, is disclosed in U.S. Pat. No. 5,251,445.

The tool disclosed in the above-noted patent utilizes a hydraulically operated forcing rod, which telescopes into and out of a hydraulic cylinder housing. A hand-operated pump, which is attached to the housing, can be manipulated to cause fluid under pressure to force the telescopic rod out of the housing against the resistance of a spring. When it is desired to retract the rod back into the housing, a lever is operated manually in order to release the hydraulic pressure and to permit the spring to retract the forcing rod back into the housing.

One of the major disadvantages of a tool of the type described, and in particular the tool disclosed in the above-noted U.S. Pat. No. 5,251,445, is that the apparatus which is utilized for maintaining pressure on the reservoir that supplies hydraulic fluid to an associated pumping device, is very expensive to manufacture, and difficult to repair. More specifically, such a mechanism utilizes a tubular forcing rod having intermediate its ends an integral partition, one side of which is attached to one end of a tension spring which is utilized to retract the forcing rod from its extended to its retracted position. The opposite side of the partition opens on one end of a fluid reservoir, the opposite end of which comprises a spring-loaded piston that reciprocates in the forward end of the forcing rod in response to changes in the pressure of the fluid which is maintained in the reservoir.

It is very difficult and time consuming to provide in the forward end of the forcing rod an elongate bore for slidably accomodating the spring loaded piston which is employed to exert pressure on the fluid in the reservoir. Also, of course, the piston must be mounted so as to prevent fluid from seeping past the piston from one end of the bore in the rod to the other end. If repairs are necessary, the entire front end of the forcing rod must be removed to gain access to the piston.

It is an object of this invention, therefore, to provide a simplified hydraulically operated tool of the type described which obviates the need for employing a spring-loaded piston within the bore of the forcing rod in order to maintain pressure on the fluid in the reservoir.

A more specific object of this invention is to provide an improved tool of the type described which utilizes novel fluid pressure generating means which are mounted on the exterior of the associated hydraulic cylinder housing rather than within the tool's forcing rod, thus considerably reducing the cost of manufacturing, and of maintaining satisfactory operation of such tool.

Other objects of the invention will be apparent hereinafter from the specification and from the recital of the appended claims, particularly when read in conjunction with the accompanying drawings.

SUMMARY OF THE INVENTION

The tool comprises a hydraulic cylinder housing containing a reciprocable forcing rod mounted for reciprocation at one end thereof in an axial bore formed in the forward end of the housing, and between a retracted position in which a paw foot on the forward end of the rod is positioned adjacent the forward end of the housing, and an extended position in which the paw foot has been advanced away from the forward end of the housing. Hydraulic fluid is forced under pressure by a hand pump on the housing into the housing bore and behind a piston head that is formed on the rod intermediate its ends. This advances the rod against the resistance of a return spring and causes fluid located in the housing bore forwardly of the piston head to be forced out of the housing, and into bores located in a pair of reservoir plates that are secured to opposite sides of the housing. Each bore in the reservoir plates contains a spring-loaded piston which exerts pressure on the fluid located in the housing forwardly of the piston head.

To retract the forcing rod a switch on the hand pump is moved to an open position in which it permits hydraulic fluid from behind the piston head to return to the housing bore forwardly of the piston head, and to allow the return spring to retract the forcing rod.

THE DRAWINGS

BRIEF DESCRIPTION OF THE PREFERRED EMBODIMENTS

Figure 1:
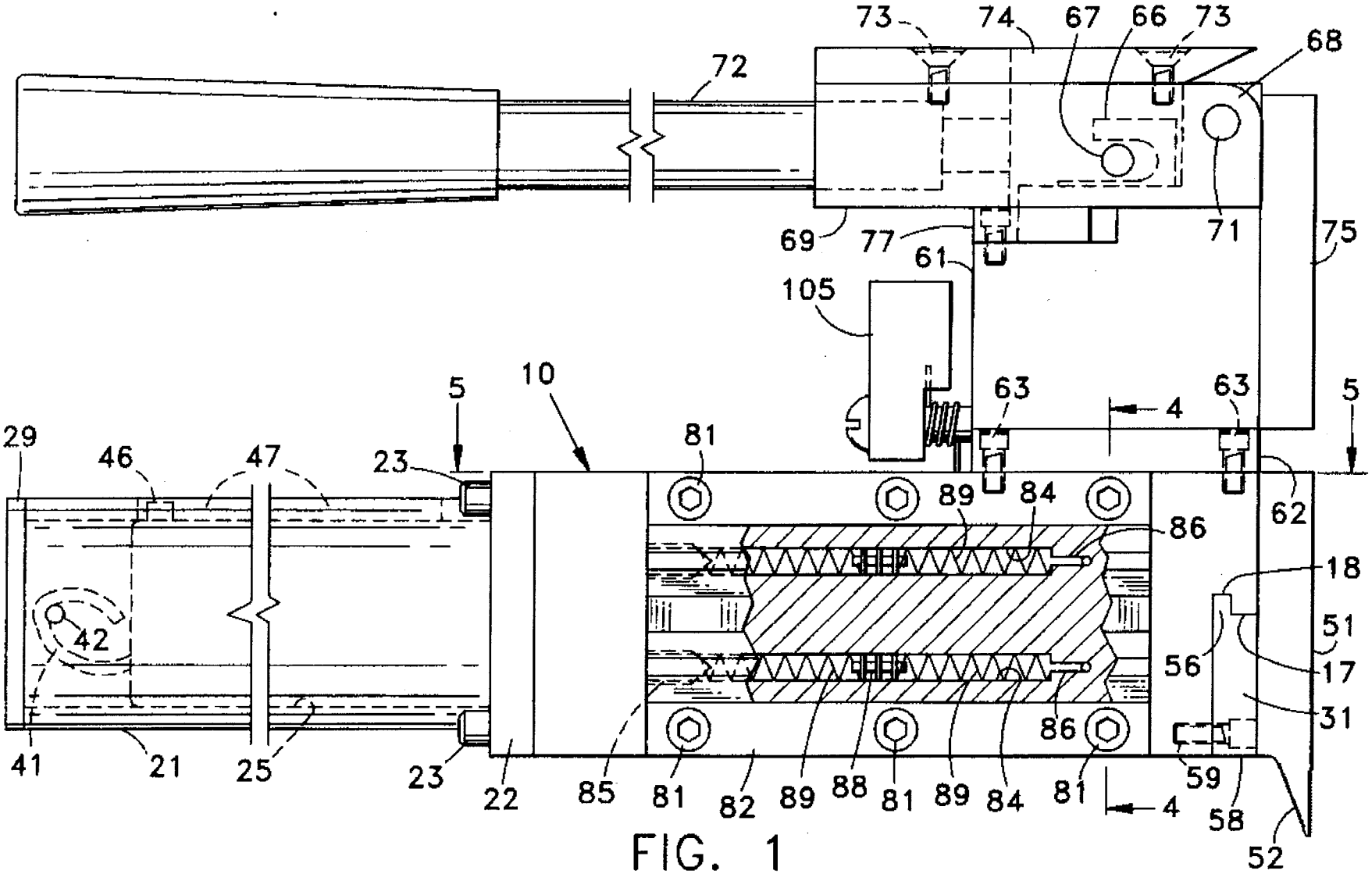
FIG. 1 is a side elevational view of a hydraulically operated forcing tool of the type made according to one embodiment of this invention, portions of the tool being broken away and shown in section for purposes of illustration.
Figure 2:
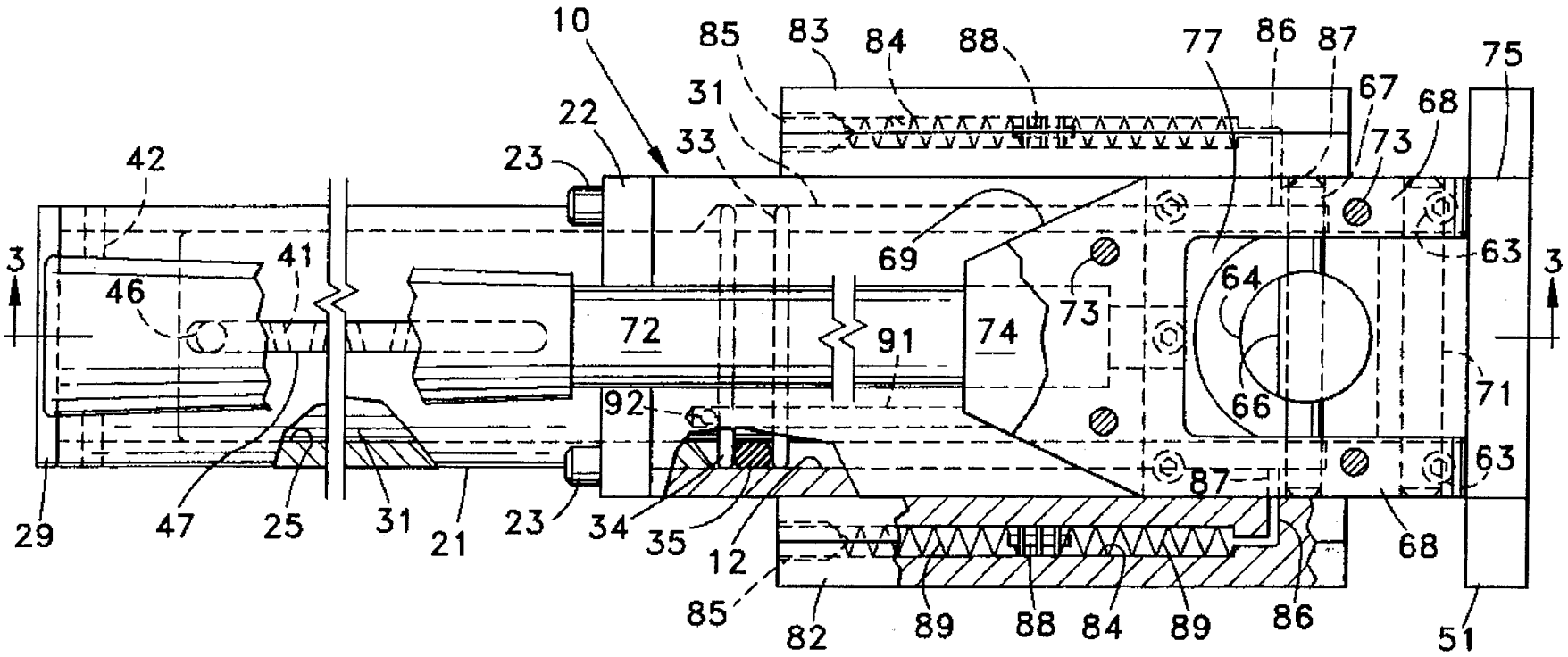
FIG. 2 is a fragmentary plan view of this tool, portions of the tool again being broken away and shown in section.
Figure 3:
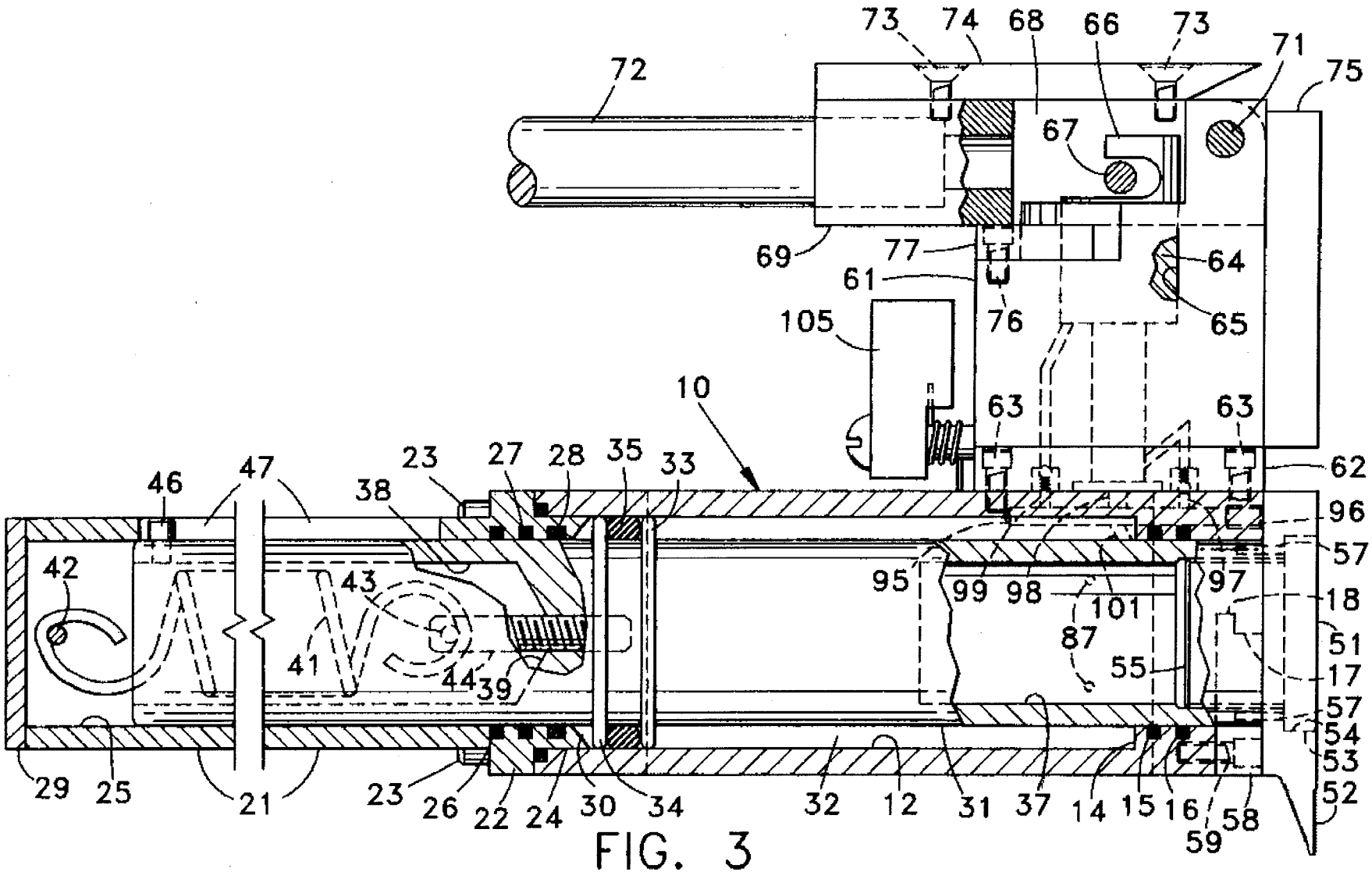
FIG. 3 is a fragmentary sectional view taken generally along the line 3—3 in FIG. 2 looking in the direction of the arrows, portions of the tool being shown in full.
Figure 4:
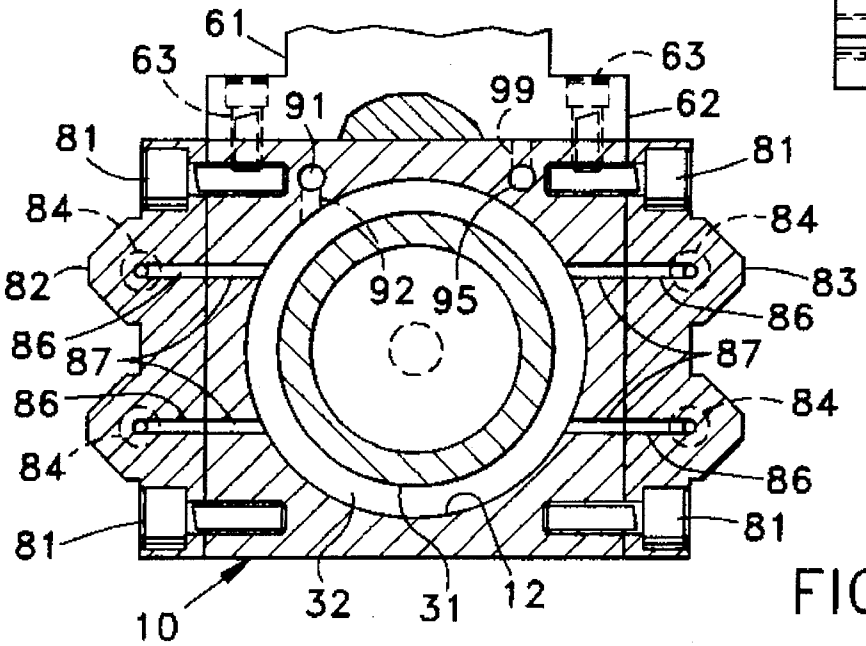
FIG. 4 is a slightly enlarged fragmentary sectional view taken generally along the line 4—4 in FIG. 1 looking in the direction of the arrow.

Referring now to the drawings by numerals of reference, 10 denotes generally a tool housing which, as shown in FIG. 4, is generally rectangular in cross section, and which has therethrough an axially extending, circular bore 12. At its forward end (the right end in FIGS. 1 to 3) bore 12 has a slightly reduced diameter which forms on the bore an internal, circumferential rib section 14 (FIG. 3) having therein a pair of axially spaced, circumferential recesses containing resilient O-rings 15 and 16 for a purpose noted hereinafter. Also, part of the forward end of housing 10 has the lower half thereof cut away, thus forming at diametrally opposite sides of bore 12 a pair of laterally spaced flat surfaces 17, which extend radially of the bore, and only one of each of which is shown in FIGS. 1 and 3. Adjacent its inner end each surface has therein a rectangular notch or recess 18 which also extends radially of bore 12.

The opposite end of housing 10 is closed by an elongate, tubular sleeve 21 having adjacent one end thereof (the right end in FIGS. 1 to 3) an integral, external shoulder 22, the outer surface of which has a rectangular configuration similar to that of rectangular housing 10. Shoulder 22 is fastened by a plurality of bolts or screws 23 to the rear or left end of housing 10 as shown in FIGS. 1 to 3. Sleeve 21 has sn annular extension 24 (FIG. 3) which extends coaxially beyond shoulder 22, and snugly and coaxially into the rear end of housing 10 coaxially of the bore 12. The bore 25 in sleeve 21 has a diameter equal to that of the internal diameter of the rib 14 on the front end of housing section 10, and has in the right end thereof a plurality (three in the embodiment illustrated) of axially spaced, circumferential recesses, which contain resilient O-rings 26, 27 and 28 (FIG. 3). The end of sleeve 21 remote from housing 10 is closed by a circular disc or end plate 29, which is secured around its marginal edge to sleeve 21 to extend transversely of and to close the adjacent end of the bore 25 in the sleeve.

Mounted for reciprocation in the registering bores 12 and 25 of the housing 10 and the sleeve 21, respectively, is an elongate, cylindrical forcing rod 31 having an outer diameter substantially equal to the diameter of the bore 25 in sleeve 21, and to the diameter of the internal, circumferential rib section 14 formed on the forward end of housing 10. Intermediate its ends the outer peripheral surface of rod 31 has sliding, sealing engagement with the O-rings 15, 16 and 26 to 28. The diameter of the bore 12 in the housing 10, however, is slightly larger than the outside diameter of the forcing rod 31, thereby forming in the annular space between the wall of bore 12 and the outer peripheral surface of the rod 31 a reservoir 32 for hydraulic fluid, as noted hereinafter. Intermediate its ends rod 31 has formed thereon a pair of integral, axially spaced, external, circumferential ribs 33 and 34, which have sliding engagement with the wall of bore 12 just forwardly or to the right of the annular extension 24 on sleeve 21. A resilient O-ring 35, which surrounds rod 31 between the ribs 33 and 34, has sliding, sealing engagement also with the wall of bore 12. Ribs 33 and 34 and the O-ring 35 thus operatively form a piston head on rod 31 intermediate its ends.

Rod 31 has formed at opposite ends thereof, respectively, axially extending bores 37 and 38 (FIG. 3) each of which extends only part way into rod 31, thereby forming in the rod intermediate its ends, an integral, transverse partition or wall 39. Extending longitudinally through the bore 38 in rod 31 is an elongate tension spring 41, one end of which (the left end in FIG. 3) is hooked or secured over a pin 42, which is secured in sleeve 21 to extend diametrally across its bore 25 adjacent the end plate 21. Spring 41 is hooked or secured at its opposite, inner end in a hole 43, which is formed in the outer end of a screw 44, the opposite end of which is threaded centrally into the partition 39 at the inner end of bore 38. Spring 41 tends to urge the rod 31 resiliently into its fully retracted position as shown in the drawings. In this position the head of a screw 46, which projects from rod 31 adjacent its left end as shown in FIG. 3, extends into and is positioned adjacent the left end (FIG. 3) of an elongate guide slot 47 that is formed in sleeve 21 intermediate its ends. When the rod 31 reciprocates between retracted and advanced positions, as noted hereinafter, the head of screw 46 slides in the slot 47 to prevent any rotation of rod 31 relative to sleeve 21 and housing 10.

Secured to the front or right end of the forcing rod 31 as shown in the drawings, is a large, generally rectangularly shaped paw or foot plate 51, which has integral with, and projecting downwardly from its lower edge a pair of laterally spaced, tapered paw or foot sections 52 (FIG. 7) each of which has both the forward and rear surfaces thereof knurled or provided with closely spaced, transversely extending grooves or notches which provide excellent gripping surfaces on the foot section 52. Plate 51 is secured over the forward end of rod 31 by a cylindrically shaped screw clamp 53 having an enlarged-diameter head section which seats in a circular recess 54 in the face of plate 51, and which has a reduced-diameter, externally threaded shank section 55 which extends through plate 51 and threads into the forward end of the bore 37 in rod 31, thereby securing plate 51 firmly over the forward end of rod 31. Two diametrally opposed dowel pins 57 (FIG. 3), which extend through plate 51 from the bottom of its recess 54 into the adjacent end of rod 31, prevent plate 51 from rotating relative to rod 31. Adjacent its lower edge the rear surface of plate 51 confronts upon a spacer plate 58, which is similar in configuration to the above-noted portion of housing 10 which is cut away from its forward end to form the surfaces 17 and slots 18. Plate 51 has a generally U-shaped upper end the tips 56 of which seat in the notches 18 in housing 10, and is removably secured by a pair of screws 59 to the forward end of housing 10 removably to fill its above-noted cut away portion for a purpose noted hereinafter.

Mounted on the forward or right end of housing 10 as shown in the drawings is a pump housing 61, which for the most part is generally similar to the pump housing employed in the above-noted U.S. Pat. No. 5,251,445, and for that reason will not be described in exact detail herein. Housing 61 has a rectangular base section 62 equal in width to the width of the housing 10, and which is secured adjacent opposite sides thereof to the top of housing 10 by a plurality of screws 63. A piston 64, which is mounted for reciprocation in a bore 65 formed in the upper end of housing 61, has at its upper end a hook-shaped projection 66 which overlies a pump operating pin 67. Pin 67 is secured at opposite ends to, and extends at right angles between, the two spaced, parallel legs 68 that are formed on the forward end (the right end in the drawings) of a generally yoke or fork-shaped pump operating plate 69. The legs 68 of plate 69 extend beyond the operating pin 67, or to the right thereof as shown in the drawings, and flank or overlie opposite sides of the upper end of the pump housing 61, and are pivotally connected thereto by a pin 71 which extends through legs 68 and housing 61 parallel to pin 67.

An elongate, generally cylindrically shaped pump handle 72, which is secured at one end at the end of plate 69 remote from its pivot pin 71, extends rearwardly (to the left) of plate 69 in spaced, overlying relationship to the housing 10 and sleeve 21. Secured by a plurality of screws 73 to the top of the pump operating plate 69 is a synthetic shocker pad 74, which may be made from NYLATRON or the lime, and the purpose of which will be noted in greater detail hereinafter. A rectangular pad 75 of like material is also secured in a conventional manner by a plurality of screws (not illustrated) to the forward face of the pump housing 61, also for a purpose noted hereinafter. Plate 75, it will be noted, overlies plate 51 when the latter is in its fully retracted position. Secured by screw 76 (FIG. 3) to the upper end of the pump housing 61 for engagement by the operating plate 69, when the latter is swung to its lowermost position, is a NYLATRON absorption pad 77 which, as noted hereinafter, minimizes any shock to the valves in the pumping system.

Secured by a plurality of screws 81 (FIGS. 1 and 4) to opposite sides of housing 10 adjacent its forward end are two, elongate, nearly identical reservoir forming plates 82 and 83. Each plate 82 and 83 has therein a pair of spaced, parallel, longitudinally extending blind bores 84, which extend inwardly from the inner or left ends of the plates 82 and 83 as shown in the drawings, and which are sealed at their outer ends (the left ends in FIGS. 1 and 2) by threaded plugs 85. Each bore 84 communicates at its inner end coaxially with one end of a right-angular, reduced diameter port 86, the opposite end of which extends laterally of the associated plate 82 or 83 and opens on its inner sidewall (the wall facing housing 10) where it registers with the outer end of one of a plurality (four in the embodiment illustrated) of ports 87, which are formed through the sides of housing 10 to place its annular reservoir 32 in communication with the bores 84 in the reservoir forming plates 82 and 83 for a purpose noted hereinafter. A piston 88 is mounted in each bore 84 between a pair of compression springs 89 for limited reciprocation in the associated bore 84 intermediate the ends thereof.

Figure 5:
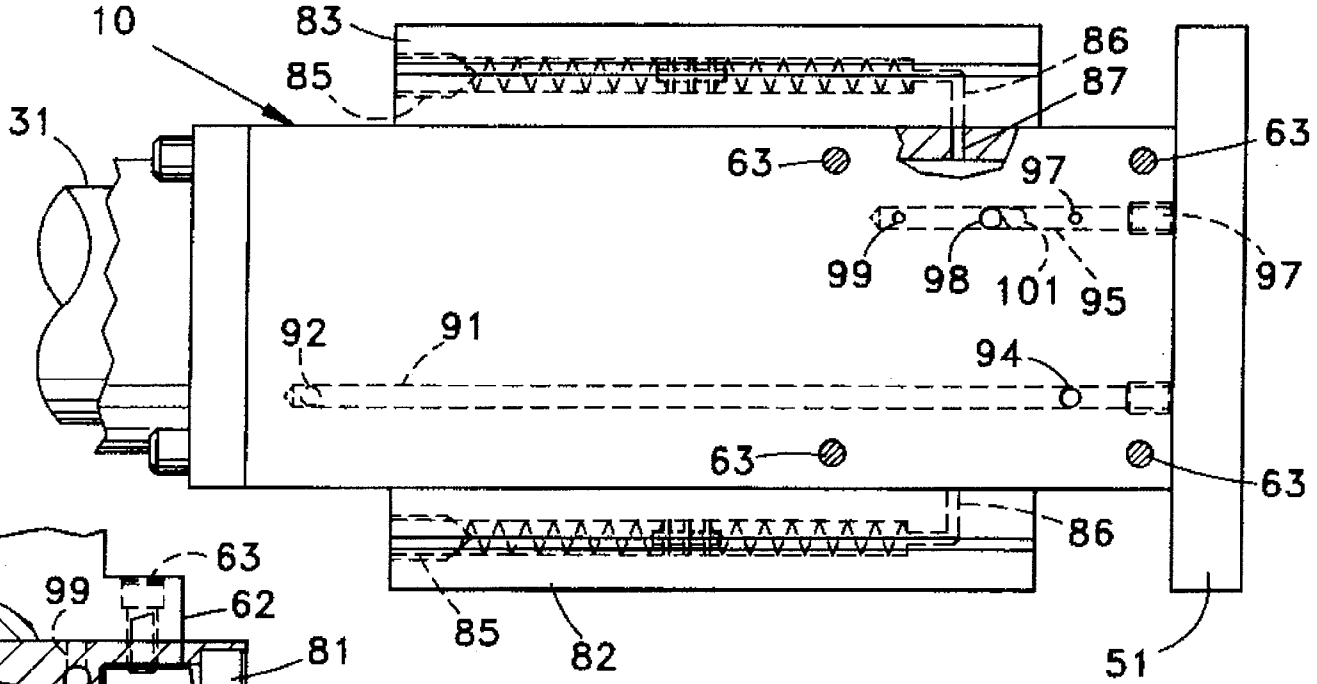
FIG. 5 is a fragmentary sectional view taken generally along the line 5—5 in FIG. 1 looking in the direction of the arrows.

Referring now to FIGS. 2, 4 and 5, housing 10 has therein adjacent its upper surface an elongate, longitudinally extending blind bore or duct 91, which extends from the forward end of the housing (the right end in the drawings) rearwardly to a point adjacent the rear end of the housing where it communicates through a port 92 (FIGS. 2, 4 and 5) with the bore 12 in the housing just forwardly of the extension 24 on sleeve 21, and just rearwardly of the shoulder 34 on rod 31 as this shoulder is illustrated in FIGS. 2 and 3. At its forward end (the right end in FIG. 5), the duct 91 is closed by a plug 93, and just inwardly of this plug, or to the left thereof as shown in FIG. 5, duct 91 communicates with a vertical port 94, which opens on the upper surface of housing 10, and which registers with the lower end of one of four ports in the bottom of the pump housing 61.

As shown more clearly in FIG. 4, the duct 91 is positioned adjacent the left side of housing 10. Positioned adjacent the right side of housing 10, and also adjacent its upper surface, is a further blind bore or duct 95, which also extends longitudinally of housing 10, but only for a short distance beyond the points where the ports 87 in the housing 10 open on its bore 12. The outer end of duct 95, which opens on the right or forward end of housing 10, is closed by a plug 96. Intermediate its ends duct 95 communicates with the lower ends of three longitudinally spaced, vertically disposed ports 97, 98 and 99, which are formed in housing 10 to communicate at their lower ends with duct 95, and at their upper ends with three further ports formed at the lower end of the pump housing 61. In addition to the ports 97, 98 and 99, duct 96 communicates through a port 101 (FIGS. 3 and 5) in housing 10 with the bore 12 in the housing, and hence with the reservoir 32.

In use, and assuming that the forcing rod 31 is in its fully retracted position as shown in the drawings, reservoir 32 will be filled with hydraulic fluid, and will be in communication through housing ports 87, and the right-angular ports 86 in the reservoir plates 82 and 83, with the spring loaded pistons 88 that are mounted for reciprocation in the bores 84. At this time, and assuming that the pressure release lever 105, which may be similar to that disclosed in the above-noted U.S. Pat. No. 5,251,445, is in the position in which it has closed the pressure relief port in housing 61.

Each time the handle 72 may be manipulated to pivot it repeatedly about its pivot pin 71, and in so doing will cause the piston 64 repeatedly to be reciprocated vertically in the bore 65 in housing 61. Each time the handle 72 is pivoted upwardly or clockwise about the axis of pin 71 as shown in FIG. 1, the piston 64 in housing 61 will cause hydraulic fluid to be drawn from the reservoir 32 through port 101 to duct 95, and through its ports 97 and 98 to the pump housing 61. As noted above, the means for performing this suction into the pump housing 61 may be similar to that disclosed in the above-noted U.S. Pat. No. 5,251,445, and consequently does not constitute part of this invention. As hydraulic fluid is drawn out of the reservoir 32 the four pistons 88 in the reservoir forming plates 82 and 83 also are drawn toward the right in FIGS. 1 and 2 against the resistance of the springs 89 located in the right ends of the bores 84, and thus slightly compressing those springs, while reducing the compression force on the springs 89 located to the left of the pistons 88 as shown in the drawings.

Thereafter as the operator swings the handle 72 downwardly or counterclockwise about the axis of pin 71, check valves in housing 61 prevent reverse flow of the fluid through the ports 97 and 98, and instead force fluid under pressure through port 94 and into the elongate duct 91 which thus conveys fluid under pressure longitudinally of the housing to port 92, from whence the fluid under pressure is directed by port 92 into the annular space or pressure chamber 30 (FIG. 3), which is formed in the bore 12 of housing 10 between the projection 24 on the inner end of sleeve 21, and the shoulder 34 on the forcing rod 31. The pressure chamber 30 is operatively separated from the reservoir chamber 32 by the piston head represented by ribs 33 and 34 and the O-ring 35 housed therebetween. As the pivotal motion of the handle 72 is repeated, fluid pressure increases in chamber 30 behind the rib 34 on rod 31, and the rod therefore is urged by this fluid toward the right in FIGS. 1 to 3 relative to the housing 10, and against the resistance of spring 41. After the fluid pressure in chamber 30 reaches a predetermined value, the valve system in housing 61 causes some fluid to be urged by the piston 64 through port 99 to duct 95, and from duct 95 through port 101 to the reservoir chamber 32 forwardly of the ribs 33 and 34 on the advancing rod 31. As this fluid under pressure enters chamber 32 it passes through the ports 87 and 86 into the right ends of the bores 84, as shown on the drawings, thereby urging the pistons 88 rearwardly in these bores toward the sleeve 21. This is necessary to prevent generation of a hydraulic lock in the device.

After the rod 31 has been advanced to its desired outer position, it may be retracted simply by manipulating the lever 105 to operate the relief valve in housing 61. When this occurs, fluid in the pressure chamber 30 in housing 10 is permitted to be discharged through port 92, duct 91 and port 94 to the pump housing 61, and from there out of the bottom of housing 61 and through the port 99 and duct 95 to the port 101, which delivers the fluid into the reservoir chamber 32 forwardly or to the right of the rib 33 on rod 31. At this time also the spring 41 functions to retract the rod 31 rearwardly to its fully retracted position, as shown for example in the drawings.

Figure 6:
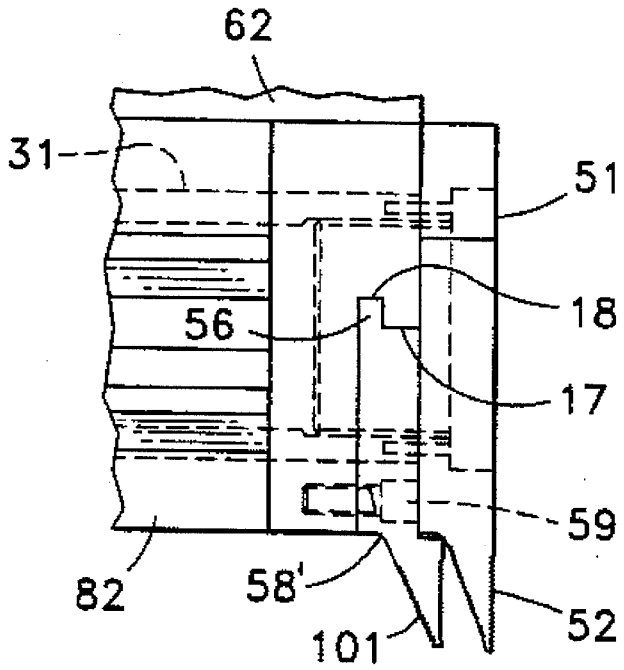
FIG. 6 is a fragmentary side elevational view of part of the front end of this tool showing a type of claw toe which can be used with this tool addition to its normal paw foot.
Figure 7:
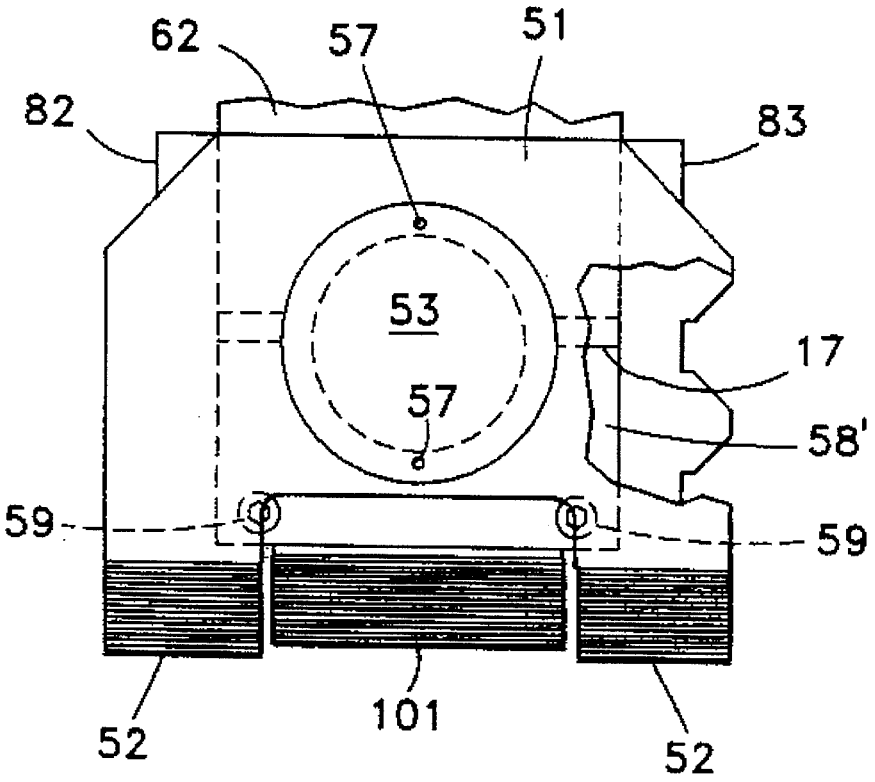
FIG. 7 is a fragmentary end elevational view of this portion of the tool as seen when looking at the right end thereof as shown in FIG. 6, portions of the tool being cut away and shown in section.

Referring now to the modification shown in FIGS. 6 and 7, when it is desired to employ the tool for forcing open or separating two closed spaced surfaces, the spacer plate 58 may be removed and replaced by a modified plate 58', which is similar in shape to plate 58, but which has integral with and projecting downwardly from its lower edge a claw toe 101 (FIG. 7). Each of the opposed surfaces of claw toe 101, like the opposed surfaces of the spaced paw or foot sections 52, is knurled or provided with closely spaced grooves or notches designed to form excellent gripping surfaces on the claw toe. As in the case of plate 58, the modified plate 58' is removably secured to housing 10 by the screws 59, and has two spaced lugs or projections 56 on the tips of its U-shaped upper end which seats in housing notches 18.

From the foregoing, it will be apparent that the present invention considerably reduces the cost of manufacturing and repairing a tool of the type described, and also permits the tool to function in a manner similar to a jack, when using only the paw foot 51, and as a separating or spreading tool, when both the paw foot 51 and claw toe 101 are employed. Either or both of the reservoir plates may be quickly removed and replaced, if necessary, thereby simplifying the manufacture and repair of the unit as compared to prior such units. Also, if desired, the partition 39 between bores 37 and 38 in rod 31 could be positioned closer to the forward or right end of rod 31 as shown in FIG. 3, which in turn would permit use of a longer and more powerful return spring 41. Also, the shock absorbing pads 74 and 77 considerably reduce the likelihood of any damage to the valves in the pump unit or housing 61. Although housing 10 has been closed at its rear end by the removable sleeve 21, this sleeve simply forms an extension of housing 10 and therefore could be made as an integral part of the housing, if desired.

While this invention has been illustrated and described in detail herein in connection with only certain embodiments thereof, it will be apparent that it is capable of still further modification, and that this application is intended to cover any such modifications as may fall within the scope of one skilled in the art, or the appended claims.

I claim:

1. A hydraulically operated forcing tool, comprising a housing having therein an axial bore, a forcing rod having a diameter less than the diameter of said bore in said housing, and having thereon intermediate its ends an enlarged diameter piston head having an outer diameter approximately equal to the diameter of said bore, means mounting said rod and said piston head in said bore for limited axial reciprocation between a retracted position in which one end of said rod is positioned adjacent one end of said housings, and an advanced position in which said one end of said rod extends out of said one end of said housing and is spaced from said one end thereof, said piston head having an outer peripheral surface slidably and sealingly engaged with the wall defining said bore in said housing and operatively separating said bore into a first chamber surrounding said rod between said piston head and said one end of said housing, and a second chamber surrounding said rod between said piston head and the opposite end of said housing, a supply of fluid in one of said chambers, pump means on said housing operable to draw fluid from said one chamber and to pump said fluid into the other of said chambers, thereby to force said piston head and said rod toward one of said advanced and retracted positions, respectively, resilient means mounted on said housing externally of said bore in said housing, and disposed in communication with the fluid in said one chamber, said resilient means being operative independently of said pump means to exert pressure on said fluid in said one chamber, said resilient means comprising at least one member removably attached to said housing and having therein at least one reservoir chamber communicating at one end thereof with the fluid in said one chamber, and a spring-loaded piston mounted for limited sliding movement in said reservoir chamber between opposite ends thereof and operative to maintain pressure on fluid entering said reservoir chamber from said one chamber.

2. A tool as defined in claim 1, wherein said member has therein a plurality of said reservoir chambers each of which communicates at one end thereof with said one chamber, and a spring-loaded piston is mounted for limited sliding movement in each of said reservoir chambers between opposite ends thereof, thereby to maintain pressure on the fluid in said one chamber.

3. A tool as defined in claim 2, wherein each of said reservoir chambers contains a pair of compression springs, and each of said spring-loaded pistons is positioned between the two compression springs of its associated reservoir chamber.

4. A tool as defined in claim 1, wherein said one chamber is said first chamber, and said housing has therein adjacent said one end thereof a radial port opening at one end on said first chamber and at its opposite end on the exterior of said housing, and said one member is removably secured to said housing with said one end of said reservoir chamber sealingly connected to said opposite end of said radial port in said housing.

5. A hydraulically operated forcing tool, comprising a housing having therein an axial bore, a forcing rod having a diameter less than the diameter of said bore in said housing, and having thereon intermediate its ends an enlarged-diameter piston head having an outer diameter approximately equal to the diameter of said bore, means mounting said rod and said piston head in said bore for limited axial reciprocation between a retracted position in which one end of said rod is positioned adjacent one end of said housing, and an advanced position in which said one end of said rod extends out of said one end of said housing and is spaced from said one end thereof, said piston head having an outer peripheral surface slidably and sealingly engaged with the wall defining said bore in said housing and operatively separating said bore into a first chamber surrounding said rod between said piston head and said one end of said housing, a second chamber surrounding said rod between said piston head and the opposite end of said housing, a supply of fluid in one of said chambers, pump means on said housing operable to draw fluid from said one chamber and to pump said fluid into the other of said chambers, thereby to force said piston head and said rod toward one of said advanced and retracted positions, respectively, resilient means mounted on said housing external of said bore in said housing, and disposed in communication with the fluid in said one chamber, said resilient means being operative independently of said pump means to exert pressure on said fluid in said one chamber, a first plate secured to said one end of said housing and having thereon an integral toe section extending laterally beyond one side of said housing, a second plate secured over said one end of said rod for reciprocation thereby between a retracted position adjacent said first plate, and an advanced position in which said second plate is spaced from said first plate, and said second plate having thereon an integral foot section which projects laterally beyond said one side of said housing in the same direction as said toe section, whereby upon reciprocation of said second plate by said rod, said foot section is reciprocated toward and away from said toe section.

6. A tool as defined in claim 5, wherein the opposed surfaces of each of said toe section and foot section, respectively, have therein a plurality of spaced, parallel grooves which extend transversely of the path of reciprocation of said rod.

7. A tool as defined in claim 5, wherein said second plate has thereon a pair of said foot sections which project laterally from said second plate in spaced, parallel relation to each other, and with the space between said foot sections registering with said toe section.

8. A hydraulically operated forcing tool, comprising a housing having therein an axial bore, a forcing rod having a diameter less than the diameter of said bore in said housing, and having thereon intermediate its ends an enlarged-diameter piston head having an outer diameter approximately equal to the diameter of said bore, means mounting said rod and said piston head said bore for limited axial reciprocation between a retracted position in which one end of said rod is positioned adjacent one end of said housing, and an advanced position in which said one end of said rod extends out of said one end of said housing and is spaced from said one end thereof, piston head having an outer peripheral surface slidably and sealingly engaged with the wall defining said bore in said housing and operatively separating said bore into a first chamber surrounding said rod between said piston head and said one end of said housing, and a second chamber surrounding said rod between said piston head and the opposite end of said housing, a supply of fluid in one of said chambers, pump means on said housing operable to draw fluid from said one chamber and to pump said fluid into the other of said chambers, thereby to force said piston head and said rod toward one of said advanced and retracted positions, respectively, resilient means mounted on said housing externally of said bore in said housing, and disposed in communication with the fluid in said one chamber, said resilient means operative independently of said pump means to exert pressure on said fluid in said one chamber, said pump means comprising a pump casing secured on said housing and having therein a piston reciprocable transversely of the axis of said bore in said housing to pump fluid from said one to said other chamber, a pump handle connected to said piston to effect reciprocation thereof, said handle being pivotally mounted adjacent one end thereof on said casing for swinging movement into and out of a position of rest in which said handle extends approximately parallel to said housing, and a resilient shock absorbing pad interposed between and engaged with said casing and said handle, when said handle is in said position of rest.

9. A tool as defined in claim 8, including a further shock absorbing pad secured to said casing to overlie said one end of said rod when said rod is in its retracted position.

10. A tool as defined in claim 1, wherein said rod has in the opposite end thereof an axial blind bore which extends part way into said rod from said opposite end thereof, and a tension spring is secured at one end to said rod at the bottom of said blind bore, and extends at its opposite end out of said blind bore and into said bore in said housing, and said opposite end of said spring is secured to said housing adjacent the opposite end thereof, whereby said spring resiliently resists movement of said rod to its advanced position.

11. A tool as defined in claim 10, wherein said rod has in said one end thereof an internally threaded, axially extending blind bore, a foot plate is mounted on said one end of said rod and has therethrough an axial bore registering with said internally threaded bore in said one end of said rod, a cylindrical screw clamp has an externally threaded shank extending through said bore in said foot plate and threaded into said internally threaded bore in said rod releasably to secure said foot plate to said one end of said rod.

12. A tool as defined in claim 11, including at least one dowel pin seated at opposite ends thereof in registering openings in said one end of said rod and in said screw clamp, respectively, thereby to resist rotation of said screw clamp relative to said rod.

13. A tool as defined in claim 12, wherein said foot plate has projecting from one edge thereof, and laterally of said housing, a pair of spaced, integral foot sections the opposed surfaces of which are knurled to form corresponding gripping surfaces on said foot sections, and a toe plate is secured to said one end of said housing and has thereon an integral toe section projecting laterally of said housing to register with the space between said foot sections, and opposed surfaces of said toe section are knurled to form corresponding gripping surfaces on said toe section.

* * * * *